US010170094B2

(12) United States Patent
Kasuga

(10) Patent No.: US 10,170,094 B2
(45) Date of Patent: Jan. 1, 2019

(54) MUSICAL SOUND GENERATING DEVICE, CONTROL METHOD FOR SAME, STORAGE MEDIUM, AND ELECTRONIC MUSICAL INSTRUMENT

(71) Applicant: CASIO COMPUTER CO., LTD., Tokyo (JP)

(72) Inventor: Kazutaka Kasuga, Tokyo (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 15/697,094

(22) Filed: Sep. 6, 2017

(65) Prior Publication Data

US 2018/0090120 A1 Mar. 29, 2018

(30) Foreign Application Priority Data

Sep. 28, 2016 (JP) ..... 2016-190427

(51) Int. Cl.
*G10H 5/00* (2006.01)
*G10H 1/043* (2006.01)
*G10H 1/06* (2006.01)

(52) U.S. Cl.
CPC ..... *G10H 5/007* (2013.01); *G10H 1/043* (2013.01); *G10H 1/06* (2013.01); *G10H 2220/361* (2013.01); *G10H 2230/205* (2013.01); *G10H 2230/241* (2013.01); *G10H 2250/141* (2013.01); *G10H 2250/465* (2013.01); *G10H 2250/515* (2013.01); *G10H 2250/521* (2013.01)

(58) Field of Classification Search
CPC ..... G10H 2220/361; G10H 2250/515; G10H 2250/535; G10H 2230/205
See application file for complete search history.

(56) References Cited

U.S. PATENT DOCUMENTS 5,543,580 A * 8/1996 Masuda ..... G10H 1/055 84/723
2007/0017352 A1* 1/2007 Masuda ..... G10H 1/053 84/658
2008/0295669 A1* 12/2008 Hashimoto ..... G10D 9/026 84/387 R
2008/0314226 A1* 12/2008 Shibata ..... G10H 1/32 84/384
2009/0019999 A1* 1/2009 Onozawa ..... G10H 1/34 84/658
2009/0020000 A1* 1/2009 Onozawa ..... G10D 7/00 84/723

(Continued)

FOREIGN PATENT DOCUMENTS

JP 2009-258238 A 11/2009

*Primary Examiner* — Marlon Fletcher
(74) *Attorney, Agent, or Firm* — Chen Yoshimura LLP

(57) ABSTRACT

An electronic musical instrument uses a mouthpiece model that models a mouthpiece as a three-dimensional shape having one end at which the mouthpiece is to be held in a mouth of a performer being smaller than another end. A processor in the instrument calculates a reflection coefficient of a progressive wave and a regressive wave using the mouthpiece model by calculating a wave impedance for the progressive wave and calculating a wave impedance for the regressive wave, and generates a musical sound signal on the basis of the calculated reflection coefficient, which is then outputted to a sound generator for sound production.

9 Claims, 8 Drawing Sheets

(56) References Cited

U.S. PATENT DOCUMENTS

2009/0038463 A1* 2/2009 Fujii ..... G10D 9/026
84/398
2014/0090547 A1* 4/2014 Udell, III ..... G10H 1/0091
84/626

* cited by examiner

MUSICAL SOUND GENERATING DEVICE, CONTROL METHOD FOR SAME, STORAGE MEDIUM, AND ELECTRONIC MUSICAL INSTRUMENT

BACKGROUND OF THE INVENTION

Technical Field

The present invention relates to a musical sound generating device, a control method for the musical sound generating device, a storage unit, and an electronic musical instrument.

Background Art

Conventionally, devices have been proposed that synthesize musical sound by modeling the sound-producing principles of musical instruments (hereafter, referred to as "modeling sound sources") (the related art disclosed in Patent Document 1, for example). In this conventional technology, the disclosed musical sound synthesizing device synthesizes the musical sound of a wind instrument. An input device specifies any of a plurality of fingerings corresponding to the same pitch in accordance with an operation performed by a user. A variable control unit sets variables such that the variables change in accordance with the fingering specified by the input device. A musical sound synthesizing unit synthesizes a musical sound in accordance with the variables by utilizing a physical model that simulates the sound produced by the wind instrument.

Patent Document 1: Japanese Patent Application Laid-Open Publication No. 2009-258238

In the above-described conventional technology, the pipe body part of a wind instrument is modeled. However, the mouthpiece or the like of single reed wind instruments also has distinct acoustic characteristics, and therefore it is possible to consider implementing the mouthpiece as a mouthpiece device by modeling the mouthpiece section. Conventionally, however, there is no known technique for suitably modelling a mouthpiece.

The present invention makes it possible to provide a musical instrument generating device that suitably models the shape of a mouthpiece, a control method for the musical instrument generating device, a storage medium, and an electronic instrument. Accordingly, the present invention is directed to a scheme that substantially obviates one or more of the problems due to limitations and disadvantages of the related art.

SUMMARY OF THE INVENTION

Additional or separate features and advantages of the invention will be set forth in the descriptions that follow and in part will be apparent from the description, or may be learned by practice of the invention. The objectives and other advantages of the invention will be realized and attained by the structure particularly pointed out in the written description and claims thereof as well as the appended drawings.

To achieve these and other advantages and in accordance with the purpose of the present invention, as embodied and broadly described, in one aspect, the present disclosure provides a musical sound generating device, including: one or more operating units having sensors that detect operations of a performer; a processor communicating with the one or more operating units, wherein the processor is configured to perform the following: determine a reflection coefficient of a progressive wave and a regressive wave using a mouthpiece model that models a mouthpiece as a three-dimensional shape having one end at which the mouthpiece is to be held in a mouth of the performer being smaller than another end, the progressive wave progressing through the modeled mouthpiece from the one end to the another end and the regressive wave regressing through the modeled mouthpiece from the another end to the one end, the reflection coefficient being determined by determined a wave impedance for the progressive wave and determining a wave impedance for the regressive wave; and generate a musical sound signal on the basis of the determined reflection coefficient and an operation of the performer sensed by the one or more operating units, and outputs the musical sound signal to a sound generator for sound production.

In another aspect, the present disclosure provides a method of generating a musical sound by a musical sound generating device having a processor and a sound generator that is connected to the processor, the method comprising causing the processor to perform the following: determine a reflection coefficient of a progressive wave and a regressive wave using a mouthpiece model that models a mouthpiece as a three-dimensional shape having one end at which the mouthpiece is held in a mouth of a performer being smaller than another end, the progressive wave progressing through the mouthpiece model from the one end to the another end and the regressive wave regressing through the mouthpiece model from the another end to the one end, the reflection coefficient being determined by determining a wave impedance for the progressive wave and a wave impedance for a second wave impedance of the regressive wave; generate a musical sound signal on the basis of the determined reflection coefficient; and output the musical sound signal to the sound generator for sound production.

In another aspect, the present disclosure provides a non-transitory storage medium having stored therein instructions executable by a processor in a musical sound generating device, the instructions causing the processor to perform the following: determine a reflection coefficient of a progressive wave and a regressive wave using a mouthpiece model that models a mouthpiece as a three-dimensional shape having one end at which the mouthpiece is held in a mouth of a performer being smaller than another end, the progressive wave progressing through the mouthpiece model from the one end to the another end and the regressive wave regressing through the mouthpiece model from the another end to the one end, the reflection coefficient being determined by determining a wave impedance for the progressive wave and a wave impedance for a second wave impedance of the regressive wave; generate a musical sound signal on the basis of the determined reflection coefficient; and output the musical sound signal to a sound generator in the musical sound generating device for sound production.

It is to be understood that both the foregoing general description and the following detailed description are exemplary and explanatory, and are intended to provide further explanation of the invention as claimed.

DETAILED DESCRIPTION OF THE EMBODIMENTS

Figure 1:
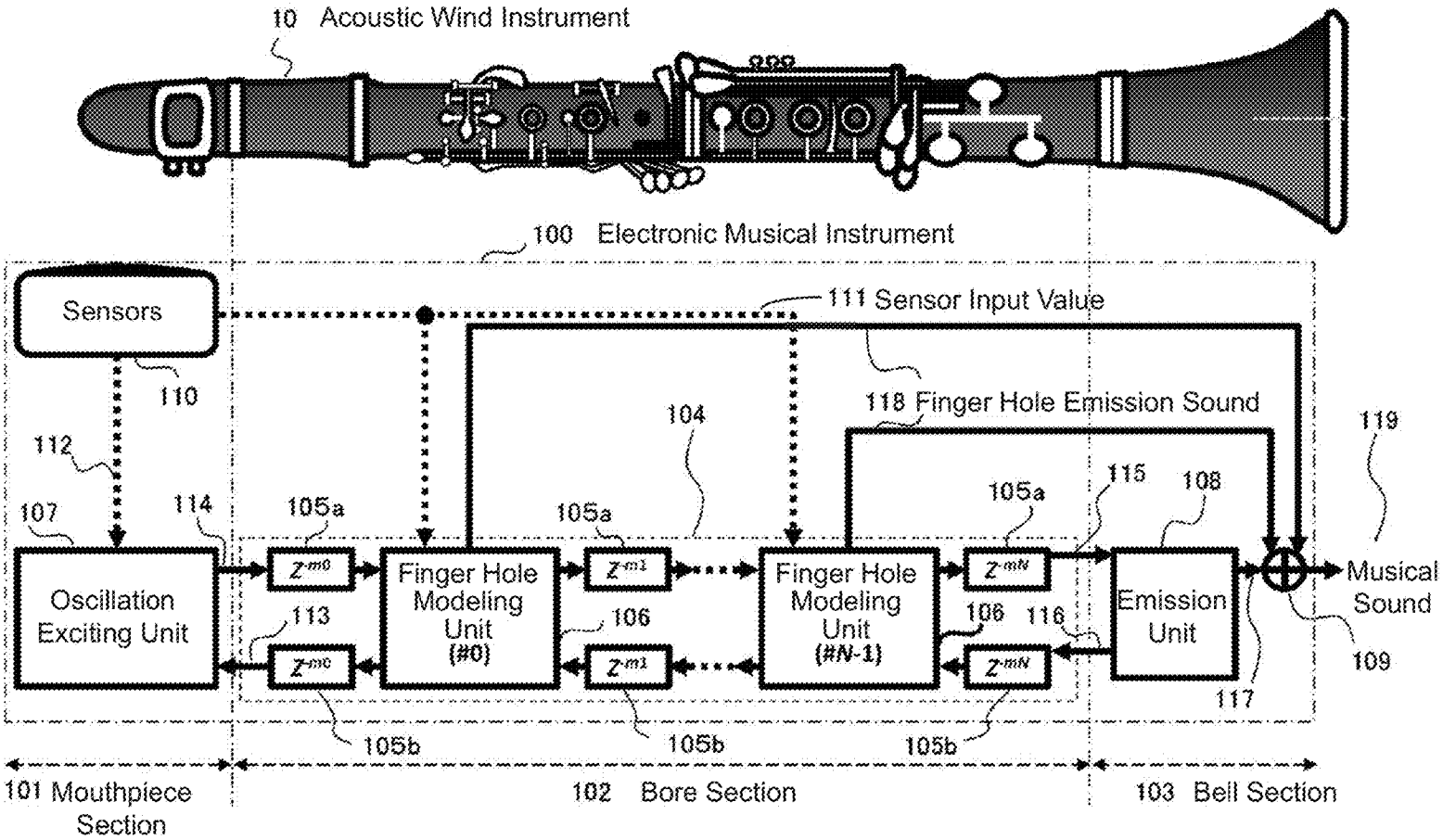
FIG. 1 illustrates a block diagram of an electronic musical instrument according to one embodiment of the present invention.

Hereafter, one embodiment for realizing the present invention will be described in detail while referring to the drawings.

FIG. 1 illustrates a block diagram of an electronic musical instrument 100 according to one embodiment of the present invention. The electronic musical instrument 100 contains a physical model sound source that physically models the acoustic characteristics of an acoustic wind instrument 10, which is, for example, a clarinet that is illustrated above the block diagram for the sake of comparison. The electronic musical instrument has a mouthpiece section 101, a bore section 102, and a bell section 103 corresponding to the respective parts of the acoustic wind instrument 10.

First, the bore section 102, which plays a central role in the physical modelling of the electronic musical instrument 100, includes a delay line section 104. The delay line section 104 executes delay line processing in which propagation of a progressive wave and a regressive wave of sound inside a pipe of a musical instrument such as a wind instrument is modeled using a combination of delay processing operations realized using digital signal processing. The delay line section 104 includes a plurality of delay processing units 105*a* that cause a progressive wave that propagates from the mouthpiece section 101 toward the bell section 103 to be sequentially delayed by delay amounts determined by $Z^{-m0}$, $Z^{-m1}$, . . . , $Z^{-mN}$, ("Z" is the transfer function of a z transform), respectively, and a plurality of delay processing units 105*b* that cause a regressive wave that propagates from the bell section 103 toward the mouthpiece section 101 to be sequentially delayed by delay amounts determined by $Z^{-m0}$, $Z^{-m1}$, . . . , $Z^{-}$mN, respectively. Here, N is an arbitrary natural number. In addition, the delay line section 104 includes the #0, #1, . . . , #N−1 finger hole modeling units 106, which are provided at delay positions #0, #1, . . . , #N−1, respectively defined as positions between $Z^{-m0}$ and $Z^{-m1}$, between $Z^{-m1}$ and $Z^{-m2}$, . . . , and between $Z^{-mN-1}$ and $Z^{-mN}$ for both progressive waves and regressive waves. The finger hole modelling units 106 execute finger hole modeling processing in which parameters relating to finger holes are selected and the behavior of sound waves in finger hole parts of the acoustic wind instrument 10 is modeled by performing digital signal processing on the basis of a sensor input value 111, which is supplied as pitch specifying information from a sensor 110 functioning as a pitch specifying switch, which may be one or more operating units having sensors to sense operations of the performer. As a result, the finger hole modeling units 106 each output part of the above-described progressive wave and regressive wave as #0, #1, . . . , #N−1 finger hole emission sounds 118. These #0, #1, . . . , #N−1 finger hole emission sounds 118 are mixed to form musical sound via an adder 109.

The mouthpiece section 101 includes an oscillation exciting unit 107. The oscillation exciting unit 107 calculates a progressive wave input signal 114 on the basis of prescribed performance input information 112, which is supplied as part of input information 110 from a sensor (not shown) (for example, a breath sensor) that detects blowing input (strength of breath, embouchure (shape of mouth), etc.) made by a performer, and on the basis of a regressive wave output signal 113 from the delay line section 104 of the bore section 102. The oscillation exciting unit 107 further causes the calculated progressive wave input signal 114 to be input to the delay line section 104.

The bell section 103 includes an emission unit 108 and a mixing unit 109. On the basis of a progressive wave output signal 115 from the delay line section 104, the emission unit 108 outputs an emission signal 117 that simulates emission from the bell section 103, and calculates a regressive wave input signal 116 and then causes the regressive wave input signal 116 to be input to the delay line section 104.

The mixing unit 109 mixes the emission signal 117 output from the emission unit 108 with the finger hole emission sounds 118 that are output from the #0, #1, . . . , #N−1 finger hole modeling units 106 and that simulate the emission of sound waves from the respective finger hole parts, and then outputs a final musical sound signal 119.

Hereafter, an operation of one embodiment of the electronic musical instrument 100 will be described.

Figure 2A:
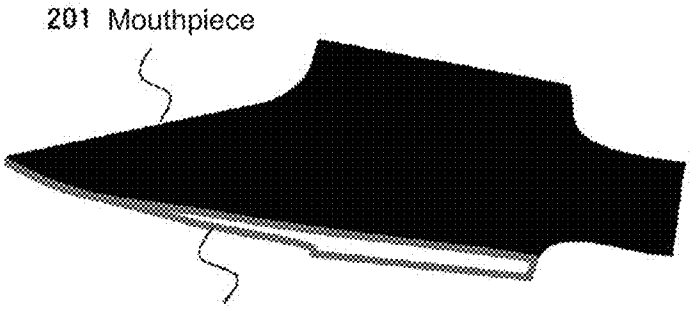
FIGS. 2A to 2C are diagrams for explaining a simple modeling of a mouthpiece (example 1).
Figure 2B:
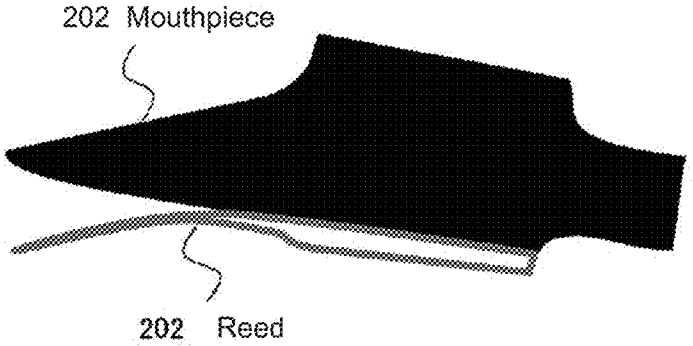
Figure 2C:
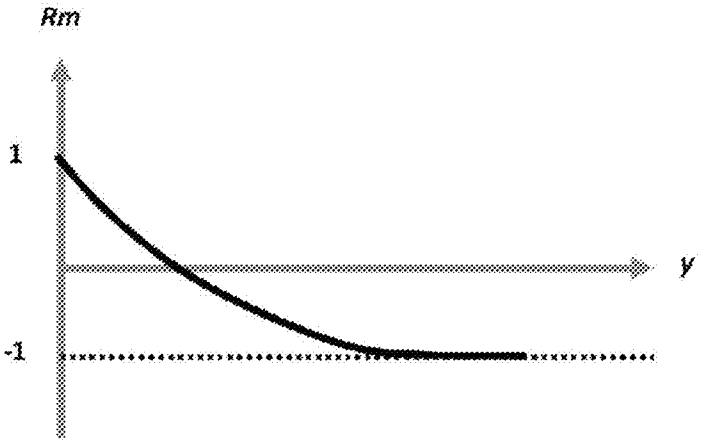

FIGS. 2A to 2C are diagrams for explaining a simple modeling of the mouthpiece section 101 (example 1). For example, the mouthpiece section 101 of a single reed wind instrument has a mouthpiece 201 and a reed 202. In the modelling shown in FIGS. 2A and 2B, a reflection coefficient $R_m$, which is a real number, is introduced and is configured to change between −1 and +1 in accordance with an opening degree y between the reed 202 and the mouthpiece 201 (FIG. 2C), where, with respect to a reflected pressure wave that returns through the inside of the pipe of the bore section 102 in FIG. 1, the model assumes the free end reflection (reflection coefficient: +1) when the reed 202 is completely closed (FIG. 2A), and the model assumes the fixed end reflection (reflection coefficient: −1) when the reed 202 is ideally open (FIG. 2B, not possible in practice).

Figure 3A:
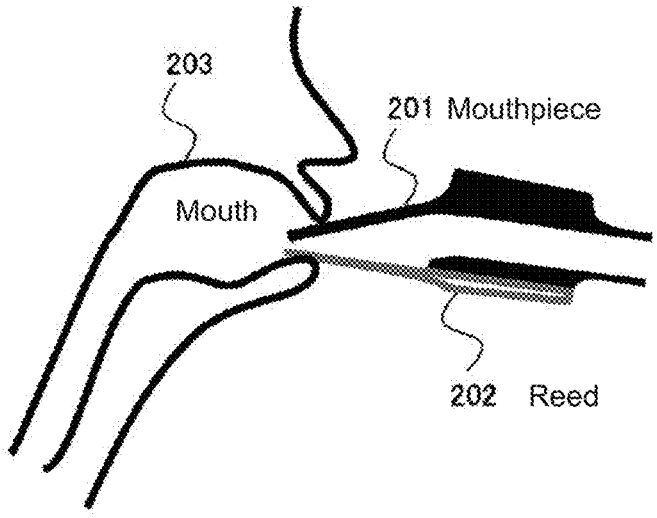
FIGS. 3A and 3B are diagrams for explaining a simple modeling of a mouthpiece (example 2).
Figure 3B:
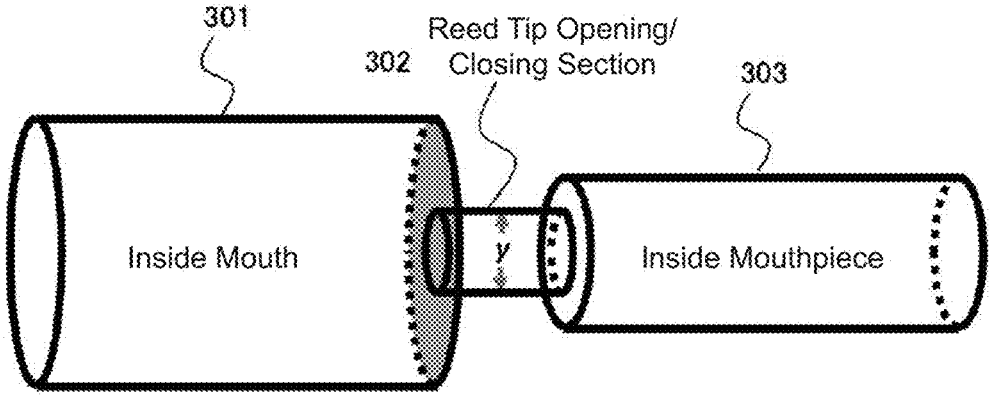

FIGS. 3A and 3B are diagrams for explaining a simple modeling of the mouthpiece section 101 (example 2). As illustrated in FIG. 3A, the mouthpiece 201 and the reed 202 are put into a mouth interior 203 of a performer and played. Thus, as illustrated in FIG. 3B, the mouth interior, a reed leading-end open/closed part (opening degree y), and the mouthpiece interior may be modeled by serially connected cylinders 301, 302, and 303.

However, modeling schemes of the mouthpiece section 101, as illustrated in FIGS. 2A-2C and FIG. 3B, are too simplified to approximate the actual shape of the mouthpiece 201, and in particular, the shape of the baffle inside the mouthpiece 201. One embodiment of the present invention makes it possible to adequately model the shape of the mouthpiece.

Figure 4:
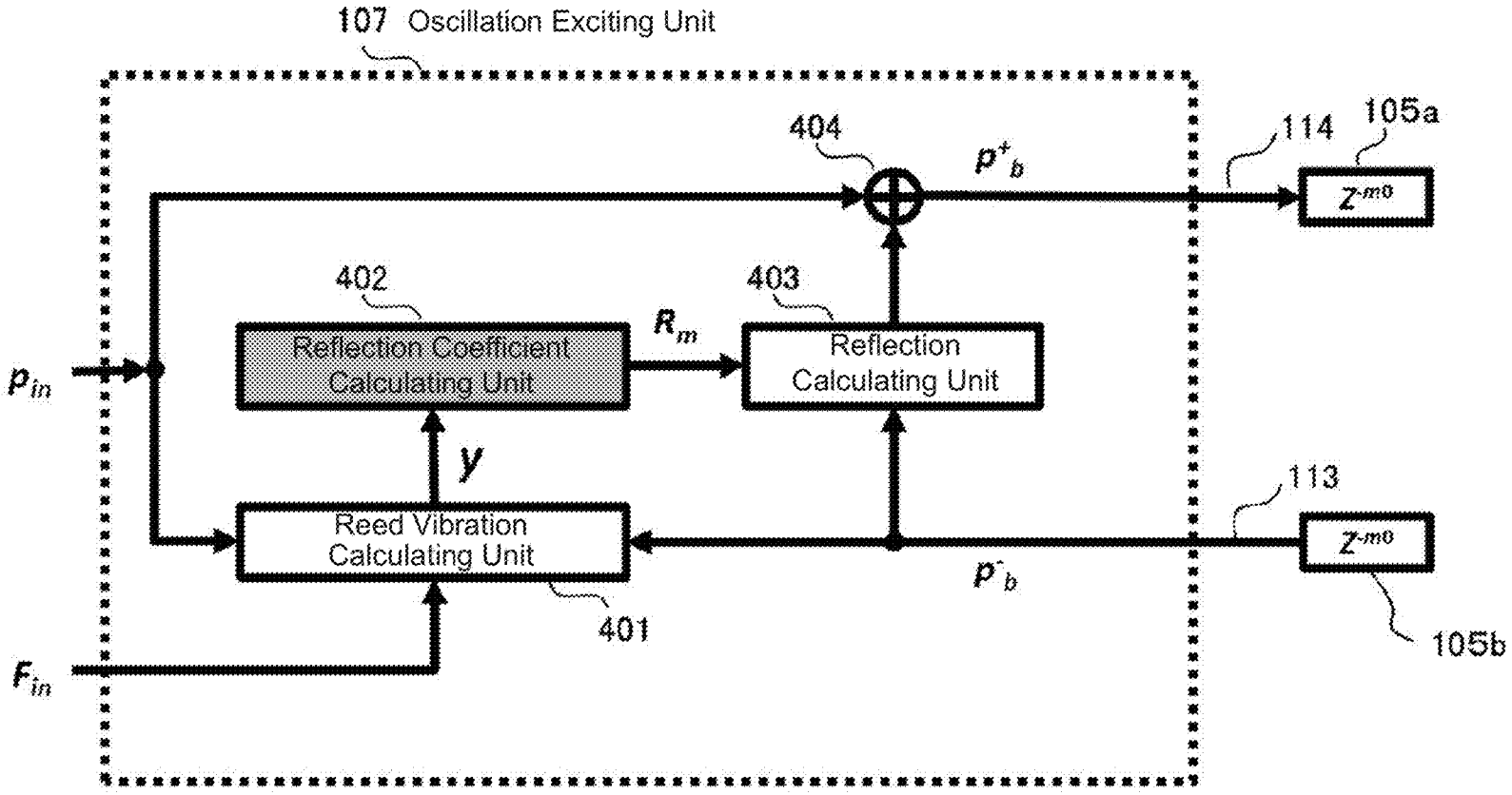
FIG. 4 illustrates an oscillation exciting unit in one embodiment of the present invention.

FIG. 4 illustrates an example of the oscillation exciting unit 107 inside the mouthpiece section 101 in FIG. 1. A reed vibration calculating unit 401 simulates vibration of the reed of a single reed wind instrument. Opening degree information expressing the distance between the mouthpiece and the reed (hereafter, "reed opening degree") y is calculated on the basis of a breath sensor input $p_{in}$ from a breath sensor that detects a blowing pressure inside the sensor unit 110 in FIG. 1, a force sensor input $F_{in}$ from a force sensor that detects the force with which the mouthpiece is held in the mouth, and a regressive wave 113, which is represented by $p^-_b$, received from the delay processing unit 105*b* at the left end inside the delay line section 104 of the bore section 102 in FIG. 1.

Figure 5B:
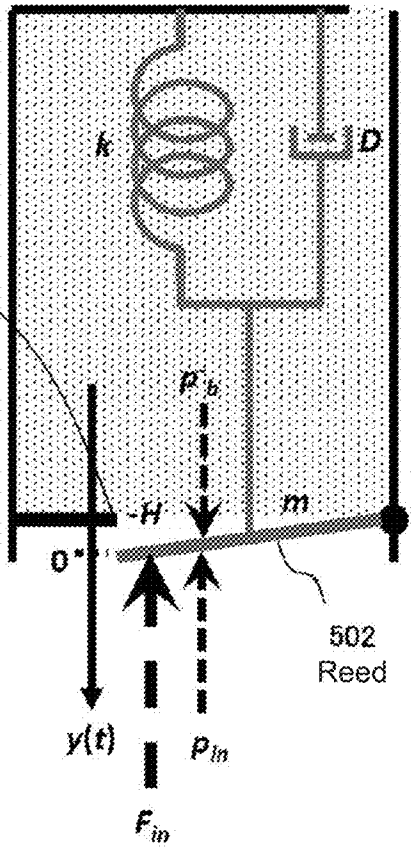
FIGS. 5A and 5B are diagrams for explaining an implementation example of a reed vibration calculating unit (mass-spring-damper model) in one embodiment of the present invention.
Figure 5A:
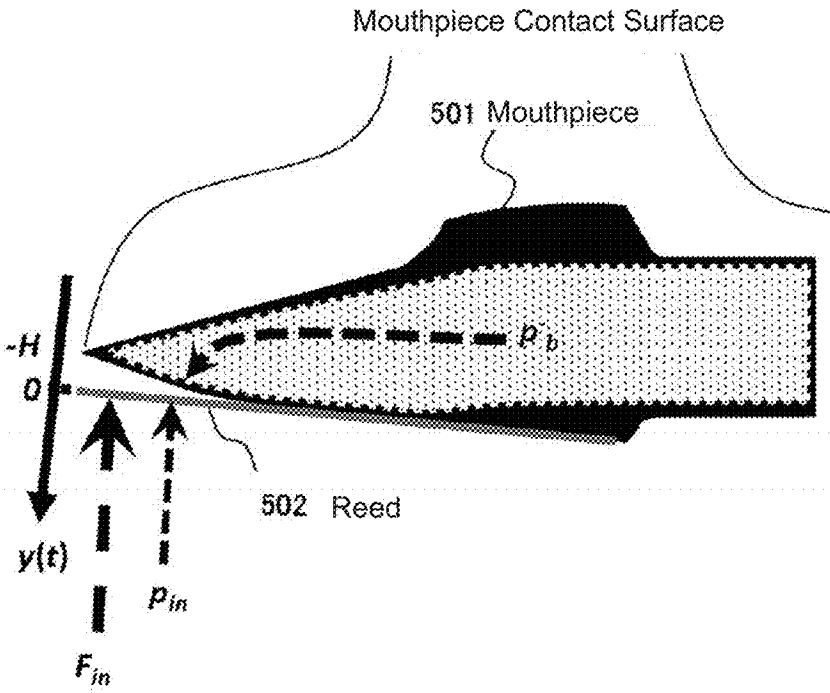

FIG. 5B illustratively shows a mass-spring-damper model as an example of implementation of the reed vibration calculating unit 401. FIG. 5A depicts a force $F_{in}$ and a pressure $P_{in}$ that act on a reed 502 of a mouthpiece 501 and a coordinate axis y along which a leading end of the reed 502 is displaced (illustrated as function y(t) of time tin FIGS. 5A and 5B, but simply "y" in following description). The position of the reed 502 on the coordinate axis y is y=0 in a state where a force is not being applied to the reed 502. A direction in which the reed 502 opens is a positive direction along the coordinate axis y. H ("−H" on coordinate axis y) represents the distance between the leading end of the reed 502 and a contact plane between the reed 502 and the mouthpiece 501 when the reed 502 is completely closed. FIG. 5B illustrates modeling of part of the reed 502 in FIG. 5A using a mass-spring-damper model, and the reed 502 is modeled as an elastic body with a mass m, a spring constant k, and a damping constant D. At this time, an equation of motion that represents vibration of the reed 502 is represented by the following formula 1. Here, $A_r$ is the effective surface area over which the pressure is applied to the reed 502. However, when y is set to be always greater than or equal to −H.

$$m\ddot{y}+D\dot{y}+ky=-A_r\{p_{in}-p_b^-\}-F_{in} \tag{1}$$

The reed vibration calculating unit 401 solves the equation of motion represented by formula 1 above.

Next, a reflection coefficient calculating unit 402 in FIG. 4 is a calculation unit that calculates, from the reed opening degree y calculated by the reed vibration calculating unit 401, the reflection coefficient $R_m$ of the progressive wave progressing inside the mouthpiece and the regressive wave regressing inside the mouthpiece. $R_m$ is reflectance expressed by a complex number and is calculated with an arithmetic expression. This arithmetic expression will be described in detail later.

A reflection calculating unit 403 causes the model of the reed 502 (FIG. 5B) to vibrate. The reflection coefficient calculating unit 402, which will be described later, calculates the reflection coefficient $R_m$ from the reed opening degree y that expresses distance between the reed 502 and the mouthpiece 501. The reflection calculating unit 403 causes part of the regressive wave 113, represented by $p^-_b$, to be reflected on the basis of the reflection coefficient $R_m$. This reflected wave is added in an adder 404 to the breath sensor input value $p_{in}$ inside the sensor unit 110 in FIG. 1 to produce progressive wave 114, which is represented by $p^{+b}$, and this is input to a progressive wave delay processing unit 105*a* on the left end inside the delay line section 104 of the bore section 102 in FIG. 1.

Figure 6:
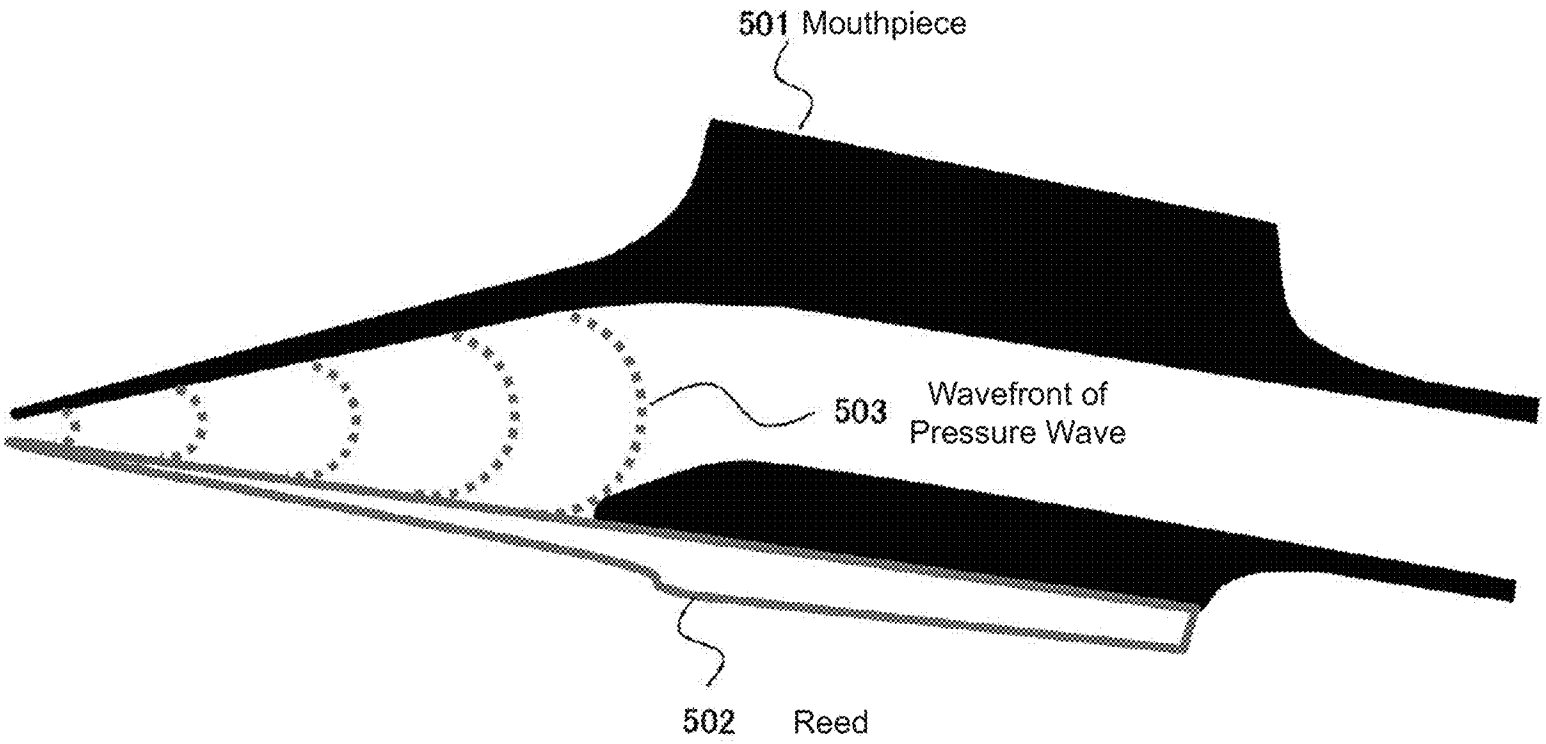
FIG. 6 is a diagram for explaining the wavefront of a pressure wave that progresses through the inside of a mouthpiece.

The modeling performed in the reflection coefficient calculating unit 402 in FIG. 4 according to the present embodiment will be described in detail. The shape of the inside of the mouthpiece 501 from a leading end thereof (the side held in the mouth during performance) to the other end thereof (the side connected to the main body of the wind instrument 10 in FIG. 1) gradually transitions from a shape that is midway between a cone and a cylindrical sector shape to a cylindrical shape. Therefore, as illustrated in FIG. 6, a wavefront of a pressure wave that advances through the inside of the shape of the mouthpiece 501 that has a shape midway between a cone and a cylindrical sector shape should be a wavefront that is midway between a spherical wave and a cylindrical wave. In this embodiment, in order to reduce the amount of calculation, an approximation is used in which it is assumed that the leading end of the mouthpiece 501 is a cone and that wave motion arising from a non-linear phenomenon (such as turbulence) is not generated. Under these assumptions, a pressure wave that advances or retreats through the leading end of the mouthpiece 501 is a spherical wave.

A pressure wave p(x, t) of a spherical wave is expressed by the following formula 2 using a complex exponential function expression.

$$p(x,t)=p^++p^-=\left(\frac{A}{x}e^{-jkx}+\frac{B}{x}e^{jkx}\right)e^{j\omega t} \tag{2}$$

Here, $p^+$ and $p^-$ respectively represent a progressive pressure and a regressive pressure, x represents a position in an advancing direction from the leading end of the cone-shaped reed 502, t represents time, A and B respectively represent the amplitude of a progressive wave and the amplitude of a regressive wave, ω represents the angular frequency, and k=ω/c represents the wavenumber (c is the speed of sound). When a volume flow rate is expressed as u(x, t), there is a relationship between p and u expressed by the following formula 3 based on Newton's laws of motion.

$$\frac{\partial p}{\partial x}=-\frac{\rho}{S(x)}\frac{\partial u}{\partial t} \tag{3}$$

Here, ρ represents the density of air and S(x) represents the surface area of a wavefront at a position x. After obtaining u from formula 2 and formula 3, the following formula 4 is obtained. Here, u+ and u− respectively represent a progressive flow amount and a regressive flow amount.

$$u(x,t)=u^++u^-=\frac{S(x)}{x\rho c}\left\{A\left(1+\frac{1}{jkx}\right)e^{-jkx}-B\left(1-\frac{1}{jkx}\right)e^{jkx}\right\}e^{j\omega t} \tag{4}$$

Therefore, the wave impedance of a spherical wave with respect to a progressive wave is calculated from the following formula 5.

$$Z^+_{mp}(j\omega,x)=\frac{p^+}{u^+}=\frac{\rho c}{S(x)}\left(\frac{jkx}{1+jkx}\right) \tag{5}$$

In addition, the wave impedance of a spherical wave with respect to a regressive wave is calculated from the following formula 6. Here, the * at the top right of the right hand side of formula 6 indicates the complex conjugate.

$$Z^-_{mp}(j\omega,x)=\frac{p^-}{u^-}=\frac{\rho c}{S(x)}\left(\frac{-jkx}{1-jkx}\right)=(Z^+_{mp})^* \tag{6}$$

Figure 7:
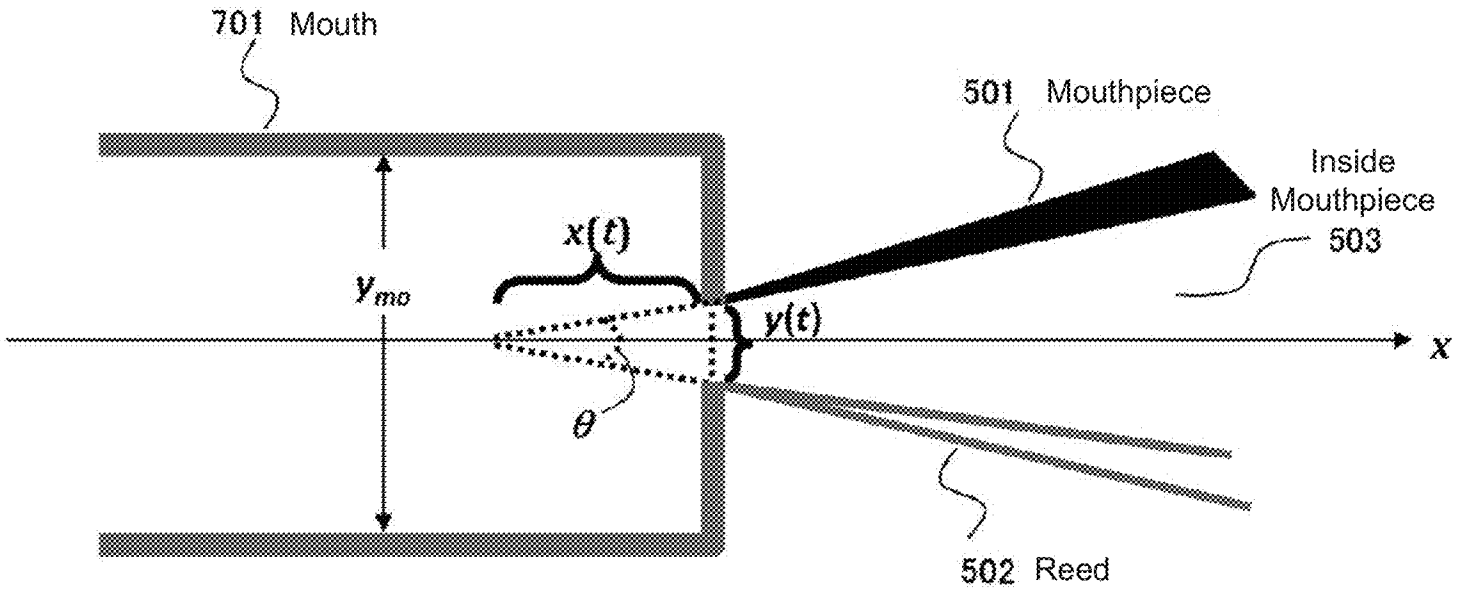
FIG. 7 illustrates a cross-sectional view of a mouthpiece model in one embodiment of the present invention (in which the mouth is modeled as a cylinder and the mouthpiece is modeled as a cone).

The reflection coefficient at the boundary between the mouth and the mouthpiece 501 can be modeled by using an impedance $Z_{mp}$ calculated using formula 5 or formula 6. FIG. 7 illustrates a sectional view for a case when a mouth 701 is modeled as a cylinder having a diameter $y_{mo}$ and a mouthpiece interior 503 is modeled as a cone. A distance x to a leading end of the cone part (in practice, x is a function "x(t)" of time t) varies with the reed opening degree y of the reed 502 (in practice, y is a function "y(t)" of time t). It is assumed that wave motion progresses and regresses in only a one-dimensional direction (x axis direction) in the inside of the mouth 701 and the mouthpiece interior 503. As described above, the reed opening degree y is information representing the degree of opening between the mouthpiece 501 and the reed 502, and is obtained as the result of a calculation in which vibration of the reed 502 is simulated in the reed vibration calculating unit 401 in FIG. 4 in accordance with the above-listed formula 1. Alternatively, y may be input as a value obtained from the sensor unit 110 in FIG. 1. The relationship between x and y is given by the following formula 7, where θ represents the angle formed between the mouthpiece 501 and the reed 502.

$$x = \frac{y}{\tan\theta(y)} \tag{7}$$

θ is written as θ(y), which means that θ changes in accordance with y. If the reed opening degree y of the reed 502 is known, θ(y) is also determined, and the distance x to the leading end of the mouthpiece 501 (leading end of cone part) can be calculated.

When y=0, x=0. In addition, although not possible in practice, the following formula 8 holds true.

$$\lim_{y \to ymo} x = \infty \tag{8}$$

Let $S_{mo}$ represent the cross-sectional area of the inside of the mouth 701. Then the characteristic impedance $Z_{mo}$ of the inside of the mouth 701 (cylinder) is expressed by the following formula 9.

$$Z_{mo} = \frac{\rho c}{S_{mo}} \tag{9}$$

The reflectance $R_m$ when a regressive pressure wave in the mouthpiece interior 503 is reflected at the boundary between the mouth 701 and the mouthpiece 501 is expressed by the following formula 10.

$$R_m = \frac{Z_{mo} - Z_{mp}^-}{Z_{mo} + Z_{mp}^+} \tag{10}$$

Therefore, based on formulas 5, 9, and 10, the reflectance $R_m$ is expressed by the following formula 11.

$$R_m = \frac{\frac{\rho c}{S_{mo}} - \frac{\rho c}{S(x)}\left(\frac{-jkx}{1 - jkx}\right)}{\frac{\rho c}{S_{mo}} + \frac{\rho c}{S(x)}\left(\frac{jkx}{1 + jkx}\right)} \tag{11}$$

In formula 11, S(x) represents the wavefront surface area of a progressive wave and a regressive wave at the boundary between the mouth 701 and the mouthpiece 501. Formula 11 is a reflection coefficient that includes the imaginary unit j and is expressed as a complex number, and is a filter in the form of a calculation. The distance x up to the leading end of the mouthpiece 501 (leading end of cone part) illustrated in FIG. 7 is known using formula 7 listed above from the reed opening degree y output from the reed vibration calculating unit 401 and S(x) can be calculated from x and the shape of the mouthpiece 501, and therefore the reflectance $R_m$ can be calculated. This calculation is executed by the reflection coefficient calculating unit 402 in FIG. 4. Here, formula 11 is a continuous time domain filter, and therefore a digital filter can be formed by subjecting formula 11 to discretization using a bilinear transform and so forth. The resulting digital filter is implemented by the reflection coefficient calculating unit 402.

The mouthpiece 501 is closed when the reed opening degree y=0, and therefore S(x)=0, and consequently the reflectance $R_m$=−1. This correctly expresses reflection at the apex of a cone. In addition, although not possible in practice, when $y \to y_{mo}$, $S(x) \to S_{mo}$, and based on formula 8, the following formula 12 holds true.

$$\lim_{y \to ymo}\left(\frac{jkx}{1 \pm jkx}\right) = \lim_{x \to \infty}\left(\frac{jkx}{1 \pm jkx}\right) = \pm 1 \tag{12}$$

Thus, the following formula 13 holds true.

$$\lim_{y \to ymo} R_m = 0 \tag{13}$$

Formula 13 expresses that the mouth 701 and the mouthpiece 501 are connected in a continuous manner, and that reflection does not occur. Therefore, the calculation of the reflectance $R_m$ using formula 11 in the modeling according to the present embodiment, which is performed by the reflection coefficient calculating unit 402 in FIG. 4 of the oscillation exciting unit 107 inside the mouthpiece section 101 in FIG. 1, enables construction of a model in which a regressive wave inside the mouthpiece is reflected in accordance with the frequency while suppressing the amount of calculation by approximating the shape of the inside of the mouthpiece 501 as a cone shape. The calculation of the reflectance $R_m$ using formula 11 is a complex number calculation, and is a model in which the reflection characteristics of a wave change with frequency when a regressive wave is reflected and becomes a progressive wave. Therefore, this modeling more closely approximates the actual physical phenomenon than modeling in which cylinders are merely connected in series with each other as described with reference to FIG. 3B above. On the other hand, the formula 11 is a linear function of angular frequency ω (=ck); thus, as a filter, the formula is a first-order filter, and the amount of calculation can be reduced. In this manner, in the present embodiment it is possible to provide an electronic musical instrument or the like in which is mounted a sound source formed by a mouthpiece model that has been modeled so as to have a three-dimensional shape (cone shape) where the end where the instrument is held in the mouth is smaller than the other end.

As another embodiment, the shape of the mouthpiece interior 503 (FIGS. 5A and 5B) may be modeled as a cylindrical sector shape. In this other embodiment, wave motion progressing or regressing through a cylindrical sector shape is a cylindrical wave and is expressed by the following formula 14.

$$p(x,t)=\{AH_\alpha^+(x)+BH_\alpha^-(x)\}e^{j\omega t} \quad (14)$$

Here, $$H_\alpha^+(x), H_\alpha^-(x)$$

is a Hankel function (Bessel function of the third kind), and the definition thereof is given by the following formula 15.

$$H_\alpha^\pm(x)=J_\alpha(x)\pm jY_\alpha(x) \quad (15)$$

Here, $J_\alpha(x)$ PS is the Bessel function of the first kind, and $Y_\alpha(x)$ is the Neumann function (Bessel function of the second kind), and the respective definitions thereof are given by the following formulas 16 and 17. Here, $\alpha$ is a constant, and $\Gamma$ is a gamma function.

$$J_\alpha(x)=\sum_{m=0}^{\infty}\frac{(-1)^m}{m!\Gamma(m+\alpha+1)}\left(\frac{x}{2}\right)^{2m+\alpha} \quad (16)$$

$$Y_\alpha(x)=\frac{J_\alpha(x)\cos(\alpha\pi)-J_{-\alpha}(x)}{\sin(\alpha\pi)} \quad (17)$$

The reflection coefficient $R_m$ in the case of modeling the mouthpiece interior as a cylindrical sector shape therefore can be obtained by calculating the wave impedances in the manner described above by applying formulas 14 to 17 in place of the above-listed formula 2. Since the Bessel function of the first kind is an infinite series, it is sufficient to perform an approximation calculation that can be handled by the calculation power of a sound source LSI (804 in FIG. 8), which is described later. In this manner, in the present embodiment, it is possible to provide an electronic instrument or the like in which is mounted a sound source formed by a mouthpiece model that has been modeled so as to have a three-dimensional shape (circular sector shape) where the end where the instrument is held in the mouth is smaller than the other end.

Figure 8:
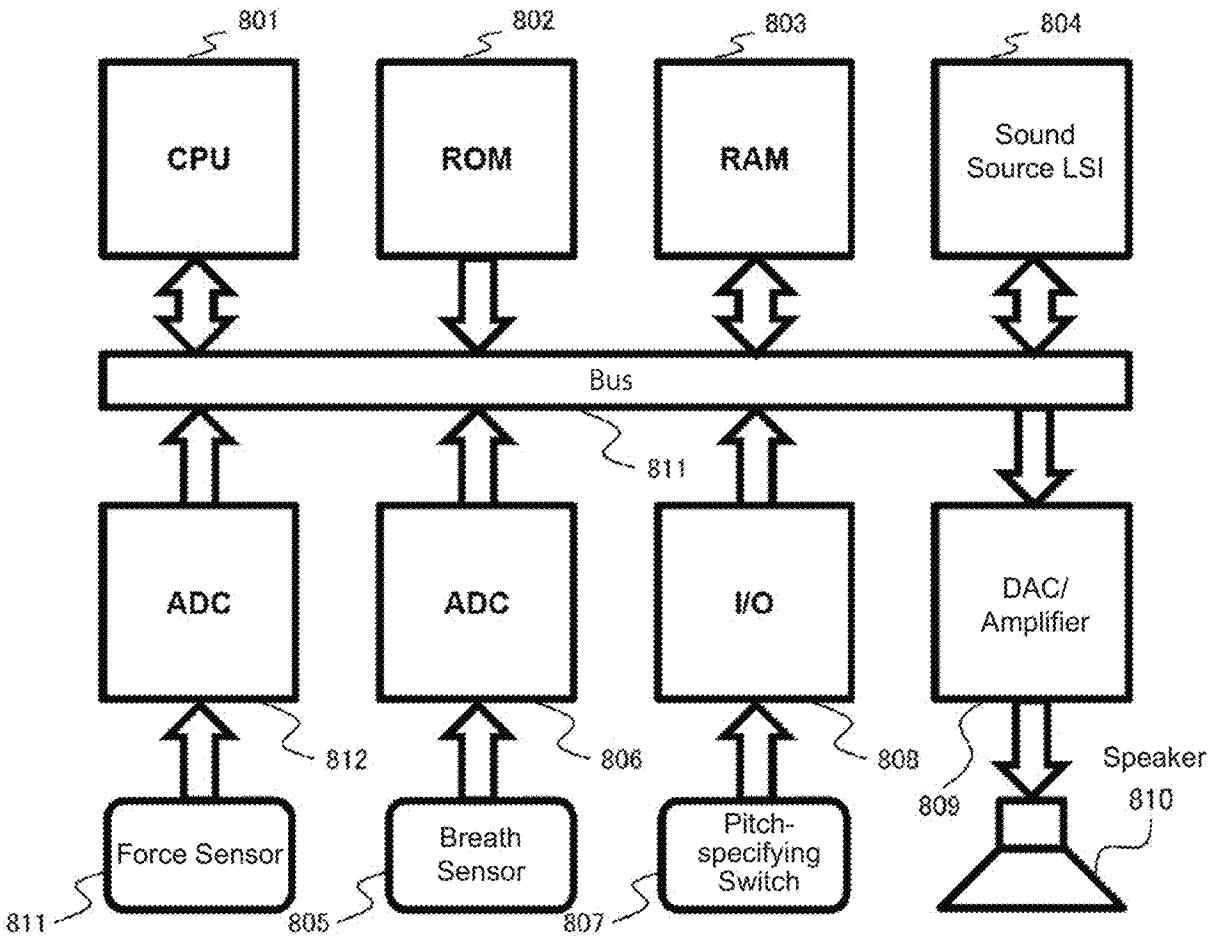
FIG. 8 illustrates hardware of an electronic musical instrument in one embodiment of the present invention.

FIG. 8 is a block diagram illustrating hardware that can realize the functions of the electronic musical instrument 100 illustrated in FIG. 1.

The example hardware illustrated in FIG. 8 includes a central processing unit (CPU) 801, a read only memory (ROM) 802, a random access memory (RAM) 803, a sound source large scale integrated circuit (LSI) 804, a breath sensor 805, an analog-to-digital converter (ADC) 806 to which the output of the breath sensor 805 is input, a force sensor 811, an ADC 812 to which the output of the force sensor 811 is input, a pitch specifying switch 807, an interface circuit (I/O) 808 to which the output of the pitch specifying switch 807 is connected, a digital-to-analog converter (DAC)/amplifier 809, and a speaker 810, and these components are connected to each other by a bus 811. FIG. 8 is one example of hardware that can realize the electronic musical instrument 100, but the present invention is not limited to this example.

The CPU 801 performs overall control of the electronic musical instrument 100. The ROM 802 stores a sound production control program. The RAM 803 temporarily stores data when the sound production control program is being executed.

The output of the breath sensor 805 is converted into a digital signal from an analog signal by the ADC 806, and is read by the CPU 801.

Each operation state of the pitch specifying switch 807 is read by the CPU 801 via the I/O 808. The pitch specifying switch may include one or more operating units having sensors to detect figure operations of the performer, for example.

The sound source LSI 804 realizes a function of generating the musical sound signal 119 in FIG. 1.

The musical sound signal 119 output from the LSI 804 is converted into an analog signal from a digital signal and then amplified in the DAC/amplifier 809 via the CPU 801, and is then output as sound via the speaker 810. The DAC/amplifier 809 together with the speaker 810 therefore is a sound generator.

In the embodiments of the present invention, the sound source LSI 804 is implemented by a digital signal processor (DSP) for example, and calculation processing operations corresponding to the functions of the delay line section 104, the oscillation exciting unit 107, and the emission unit 108 in FIG. 1 are executed in real time in every sampling period for the musical sound signal 119. By adopting one of the mouthpiece models, described above, which has been modeled so as to have a three-dimensional shape where the end where the instrument is held in the mouth is smaller than the other end, the oscillation exciting unit 107 in FIG. 1, an example of which is illustrated in FIG. 4, implements processing in which the amount of calculation is suppressed and that can rapidly and accurately calculate the reflection of a pressure wave between a mouth and a mouthpiece while approximating the shape of the mouthpiece to the shape of the mouthpiece of a natural musical instrument.

Furthermore, the CPU 801 executes a control program (not shown) stored in the ROM 802 to determine the delay positions of the finger hole modelling units 106 (i.e., determine which finger hole modeling unit should be in the state of open or closed) that can best represent the pitch specified by pitch specifying information 111 (FIG. 1) input via the I/O 808 from the pitch specifying switch 807 and informs the sound source LSI 804 of this delay position information. Next, the CPU 801 reads out finger hole parameters corresponding to the pitch specified or the determined delay positions from the ROM 802, calculates setting values of the respective calculation units among the finger hole modeling units 106 on the basis of these finger hole parameters, and informs the sound source LSI 804 of these setting values.

It will be apparent to those skilled in the art that various modifications and variations can be made in the present invention without departing from the spirit or scope of the invention. Thus, it is intended that the present invention cover modifications and variations that come within the scope of the appended claims and their equivalents. In particular, it is explicitly contemplated that any part or whole of any two or more of the embodiments and their modifications described above can be combined and regarded within the scope of the present invention.

What is claimed is:

1. A musical sound generating device comprising:

one or more operating units having sensors that detect operations of a performer;

a processor communicating with said one or more operating units, wherein the processor is configured to perform the following:

determine a reflection coefficient of a progressive wave and a regressive wave using a mouthpiece model that models a mouthpiece as a three-dimensional shape having one end at which the mouthpiece is to be held in a mouth of the performer being smaller than another end, the progressive wave progressing through the modeled mouthpiece from said one end to said another end and the regressive wave regressing through the modeled mouthpiece from said another end to said one end, the reflection coefficient being determined by determining a wave impedance for the progressive wave and determining a wave impedance for the regressive wave; and generate a musical sound signal on the basis of the determined reflection coefficient and an operation of the performer sensed by said one or more operating units, and outputs the musical sound signal to a sound generator for sound production, wherein the processor determines a degree of opening of a reed relative to the mouthpiece on the basis of detection values from a sensor that detects how the mouthpiece is held in the mouth of the performer and the regressive wave that is determined from detection values from the sensors of the one or more operating units that detect finger operations of the performer, and wherein the processor determines the reflection coefficient in accordance with the determined degree of opening.

2. The musical sound generating device according to claim 1, wherein the three-dimensional shape is a conical shape.

3. The musical sound generating device according to claim 1, wherein the three-dimensional shape is a circular sector shape.

4. The musical sound generating device according to claim 1, wherein the mouthpiece model used by the processor models an inside of the mouthpiece as a cone, and the processor further uses a mouth model that models the mouth as a cylinder, wherein the processor regards the progressive wave and the regressive wave as spherical waves p(x, t) represented by the following formula 1, and $$p(x,t) = p^{+} + p^{-} = \left(\frac{A}{x}e^{-jkx} + \frac{B}{x}e^{jkx}\right)e^{j\omega t} \tag{1}$$

wherein the processor calculates the reflection coefficient denoted as $R_m$ by performing a digital filter operation of the following formula 2 that is derived using formula 1, $$R_m = \frac{\frac{\rho c}{S_{mo}} - \frac{\rho c}{S(x)}\left(\frac{-jkx}{1-jkx}\right)}{\frac{\rho c}{S_{mo}} + \frac{\rho c}{S(x)}\left(\frac{jkx}{1+jkx}\right)} \tag{2}$$

where $p^{+}$ represents a progressive pressure, $p^{-}$ represents a regressive pressure, x represents a distance from a boundary between the mouth and the mouthpiece to a leading end of the cone calculated from the degree of opening of the reed, t represents time, A represents an amplitude of the progressive wave, B represents an amplitude of the regressive wave, ω represents angular frequency, k=ω/c represents a wavenumber, c represents the speed of sound, S(x) represents a wavefront surface area at the boundary between the mouth and the mouthpiece calculated on the basis of x, $S_{mo}$ represents a cross-sectional area of the cylinder, ρ represents the density of air, and j represents the imaginary unit.

5. The musical sound generating device according to claim 1, wherein the mouthpiece model used by the processor models an inside of the mouthpiece as a cylindrical sector shape, and the processor further uses a mouth model that models the mouth as a cylinder, wherein the processor regards the progressive wave and the regressive wave as cylindrical waves p(x, t) represented by the following formula 3 together with formula 4, formula 5, and formula 6:

$$p(x,t) = \{AH_{\alpha}^{+}(x) + BH_{\alpha}^{-}(x)\}e^{j\omega t} \tag{3}$$

$$H_{\alpha}^{\pm}(x) = J_{\alpha}(x) \pm jY_{\alpha}(x) \tag{4}$$

$$J_{\alpha}(x) = \sum_{m=0}^{\infty} \frac{(-1)^m}{m!\Gamma(m+\alpha+1)}\left(\frac{x}{2}\right)^{2m+\alpha} \tag{5}$$

$$Y_{\alpha}(x) = \frac{J_{\alpha}(x)\cos(\alpha\pi) - J_{-\alpha}(x)}{\sin(\alpha\pi)} \tag{6}$$

where $H_{\alpha}^{+}(x)$, $H_{\alpha}^{-}(x)$ are Hankel functions, which are the third kind Bessel functions, $J_{\alpha}(x)$ is a first kind Bessel function, $Y_{\alpha}(x)$ is a Neumann function, which is second kind Bessel function, α is a constant, Γ is a gamma function, and π is Pi, and wherein the processor calculates the reflection coefficient by calculating the wave impedance for the progressive wave and the wave impedance for the regressive wave using formula 3, formula 4, formula 5, and formula 6.

6. The musical sound generating device according to claim 1, wherein the reflection coefficient calculated by the processor is a reflectance expressed by a complex number.

7. A method of generating a musical sound by a musical sound generating device having a processor and a sound generator that is connected to the processor, the method comprising causing the processor to perform the following:

determine a reflection coefficient of a progressive wave and a regressive wave using a mouthpiece model that models a mouthpiece as a three-dimensional shape having one end at which the mouthpiece is held in a mouth of a performer being smaller than another end, the progressive wave progressing through the mouthpiece model from said one end to said another end and the regressive wave regressing through the mouthpiece model from said another end to said one end, the reflection coefficient being determined by determining a wave impedance for the progressive wave and a wave impedance for a second wave impedance of the regressive wave;

generate a musical sound signal on the basis of the determined reflection coefficient; and output the musical sound signal to the sound generator for sound production, wherein the method further comprises causing the processor to determine a degree of opening of a reed relative to the mouthpiece on the basis of detection values from a sensor that detects how the mouthpiece is held in the mouth of the performer and the regressive wave that is determined from detection values from the sensors of the one or more operating units that detect finger operations of the performer, and wherein the reflection coefficient is determined in accordance with the determined degree of opening.

8. A non-transitory storage medium having stored therein instructions executable by a processor in a musical sound generating device, said instructions causing the processor to perform the following:

determine a reflection coefficient of a progressive wave and a regressive wave using a mouthpiece model that models a mouthpiece as a three-dimensional shape having one end at which the mouthpiece is held in a mouth of a performer being smaller than another end, the progressive wave progressing through the mouthpiece model from said one end to said another end and the regressive wave regressing through the mouthpiece model from said another end to said one end, the reflection coefficient being determined by determining a wave impedance for the progressive wave and a wave impedance for a second wave impedance of the regressive wave;

generate a musical sound signal on the basis of the determined reflection coefficient; and output the musical sound signal to a sound generator in the musical sound generating device for sound production, wherein said instructions further causes the processor to determine a degree of opening of a reed relative to the mouthpiece on the basis of detection values from a sensor that detects how the mouthpiece is held in the mouth of the performer and the regressive wave that is determined from detection values from the sensors of the one or more operating units that detect finger operations of the performer, and wherein the reflection coefficient is determined in accordance with the determined degree of opening.

9. An electronic musical instrument, comprising:

the musical sound generating device according to claim 1; and said sound generator connected to the processor of the musical sound generating device.

* * * * *